US005367715A

United States Patent [19]

Leonard et al.

[11] Patent Number: 5,367,715

[45] Date of Patent: Nov. 29, 1994

[54] BIKINI BOTTOM OR BRIEFS

[75] Inventors: Cynthia D. Leonard; Lawrence Gayne, both of North York, Canada

[73] Assignee: L.C.C. Consulting Inc., North York, Canada

[21] Appl. No.: 140,509

[22] Filed: Oct. 25, 1993

[51] Int. Cl.[5] ..... A41B 9/00; A41D 27/00

[52] U.S. Cl. ..... 2/401; 2/400; 2/403; 2/406; 450/143; 450/156

[58] Field of Search ..... 2/46, 69, 69.5, 75, 2/80, 79, 227, 400, 401, 402, 403, 404, 405, 406, 407, 408; 604/393, 385.1; 450/41, 42, 43, 44, 45, 46, 47, 48, 49, 50, 51, 52, 114, 132, 135, 143, 156

[56] References Cited

U.S. PATENT DOCUMENTS 3,339,208 9/1967 Marbach ..... 2/67

*Primary Examiner*—Jeanette E. Chapman
*Attorney, Agent, or Firm*—George A. Seaby

[57] ABSTRACT

In general, bikini bottoms or briefs are somewhat unimaginative in terms of shape, uncomfortable and expensive to produce. A relatively simple frame for use in bikini bottoms or briefs includes two lengths of wire which are bent to define mirror images of each other, the lengths defining a major portion of an oval of sufficient length to extend around the crotch of a wearer between a V-shaped line across the rectus abdominous muscle in the front and the sacrum in the rear of the wearer. Each of the lengths of wire includes a straight, vertical rear portion extending downwardly from an inverted L-shaped top rear end to approximately the bottom center of the crotch area, and a front portion flaring outwardly and upwardly from the vertical plane of the straight rear portion to a top end and then downwardly to the vertical plane of the rear portion. The two lengths of wire are interconnected using conventional cable connectors to define a T-shaped rear and a generally triangular front with a V-shaped depression in the top thereof. When the frame is covered with a fabric or other flexible cover, the resulting bikini bottom or briefs includes a triangular front panel with a V-shaped depression in the top edge thereof, a narrow, generally rectangular strip in the crotch area and a triangular rear panel with a straight top edge.

6 Claims, 5 Drawing Sheets

BIKINI BOTTOM OR BRIEFS

BACKGROUND OF THE INVENTION

FIELD OF THE INVENTION

This invention relates to a bikini bottom or briefs.

More specifically, the invention relates to a frame for a bikini bottom or briefs, and the bikini bottom or briefs produced by covering the frame.

DISCUSSION OF THE PRIOR ART

In general, bikini bottoms or briefs are formed of a fabric, which is cut and sewn to produce an article of clothing having the desired shape and size. The articles are substantially tubular, including a top opening for the hips or waist of the wearer and a pair of bottom openings for the legs. In the past, such bottoms or briefs have been produced using a resilient frame covered with fabric, the use of a frame beneath the fabric enabling the manufacturer to omit the portions of the article extending around the waist of the wearer. Articles of this type are disclosed for example in U.S. Pat. No. 2,534,934, which issued to F. Viniegra on Dec. 19, 1950; U.S. Pat. No. 3,339,208, which issued to R. L. Marbach on Sep. 5, 1967 and U.S. Pat. No. 4,934,781, which issued to O. Axmann on Jul. 26, 1983, and French Patent No. 2,481,893, which issued to V. O. Denis on Nov. 13, 1981.

In articles of the type in questions, aside from the question of cost, there are two considerations which need be addressed, namely the appearance of the finished product and comfort. In general, devices of the type described in the above listed patents are expensive to produce, uncomfortable or somewhat uninteresting in terms of shape or pattern. Other problems are the fact that the patented articles are not properly supported on the body of the wearer and/or are unlikely to retain their shape during use.

GENERAL DESCRIPTION OF THE INVENTION

An object of the present invention is to offer a solution to the above-identified problems in the form of a relatively simple yet aesthetically pleasing bikini bottom or briefs, and a frame for producing such an article of manufacture.

Another object of the invention is to provide a frame for a bikini bottom or briefs which is easy to produce and which results in a is relatively comfortable product which retains its shape on the wearer.

Accordingly, the present invention relates to a frame for a bikini bottom or briefs comprising a resilient wire member defining a major portion of an oval of sufficient length to extend around the crotch area of a wearer between the rectus abdominous muscle in the front and the sacral area in the rear, said wire member including a generally T-shaped top rear end, a rectilinear rear portion extending downwardly form said top rear end to approximately the bottom center of the crotch area, and a generally triangular front portion, said front portion having a generally V-shaped depression in the top thereof.

In more specific terms, the invention relates to a frame for a bikini bottom or briefs comprising a pair of resilient wire members, one said wire member being the mirror image of the other said wire member, each said wire member defining a major portion of an oval of sufficient length to extend around the crotch of a wearer between approximately a V-shaped line on the rectus abdominous muscle in the front and the sacrum in the rear of the wearer, each said member including a rectilinear rear portion for extending downwardly from the top rear of the frame to approximately the bottom center of the crotch area, an outwardly extending rear arm at the top of the rear portion, and a front portion including a side flaring outwardly from the vertical plane of said rectilinear rear portion to a top end and a front arm extending downwardly and inwardly from said top end to said vertical plane; and connector means for interconnecting said frame members to define a T-shaped rear and a generally triangular front, said front having a generally V-shaped depression in the top thereof.

BRIEF DESCRIPTION OF THE DRAWINGS

The invention will be described in greater detail with reference to the accompanying drawings, which illustrate a preferred embodiment of the invention, and wherein.

DESCRIPTION OF PREFERRED EMBODIMENT

Figure 2:
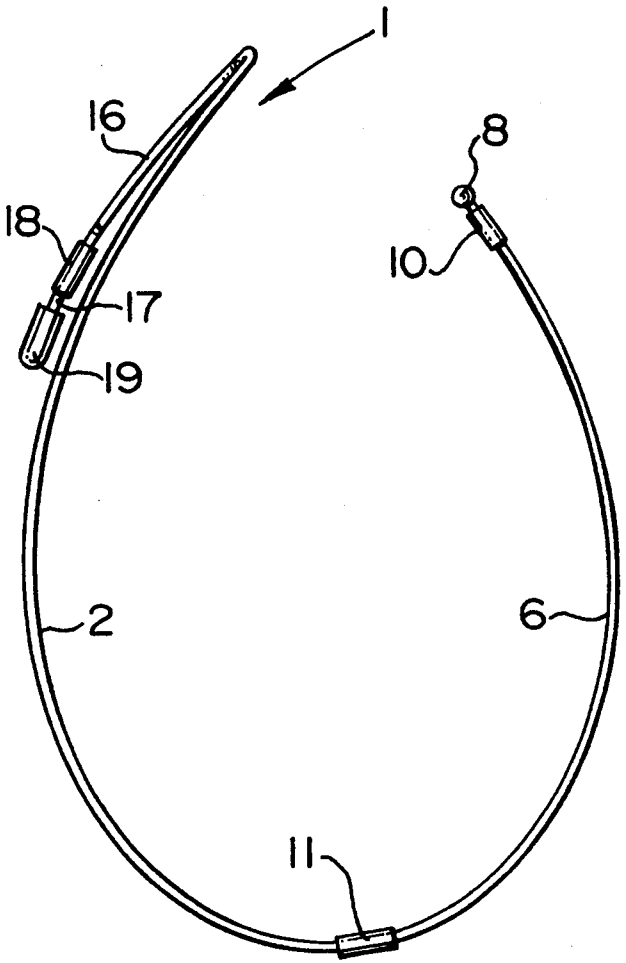
FIG. 2 is a side view of the frame of FIG. 1.
Figure 1:
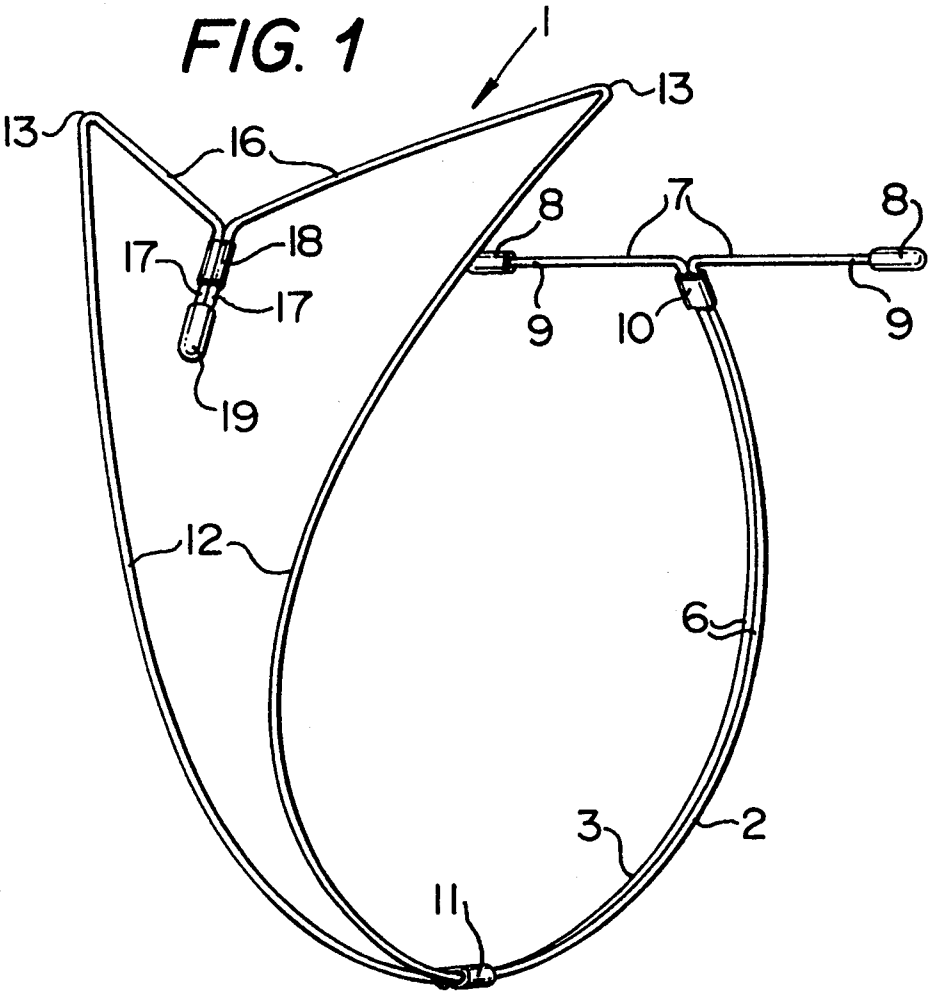
FIG. 1 is a perspective view from the front and one side of a frame for use in a bikini bottom or briefs in accordance with the present invention.
Figure 3:
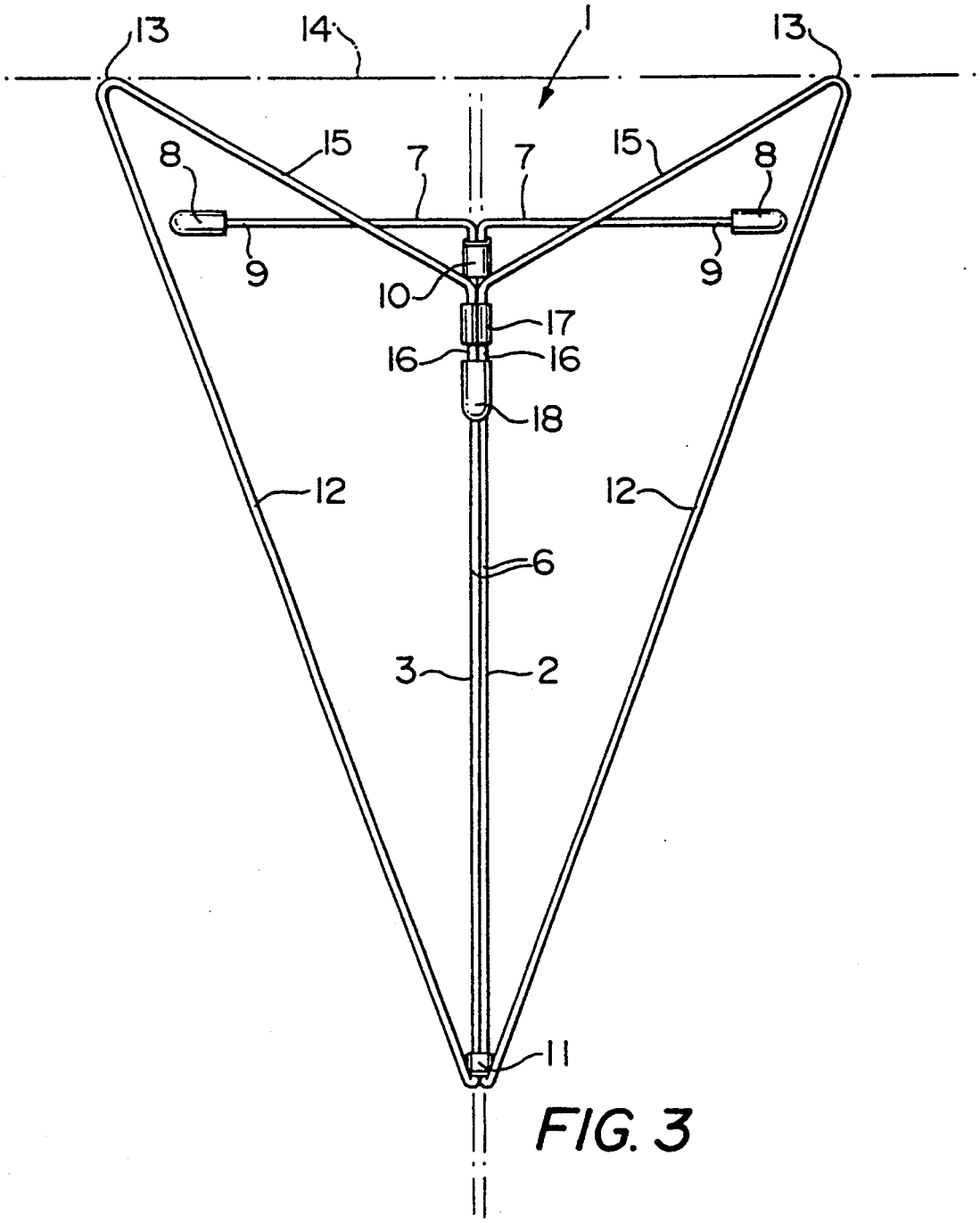
FIG. 3 is a front view of the frame of FIGS. 1 and 2.
Figure 4:
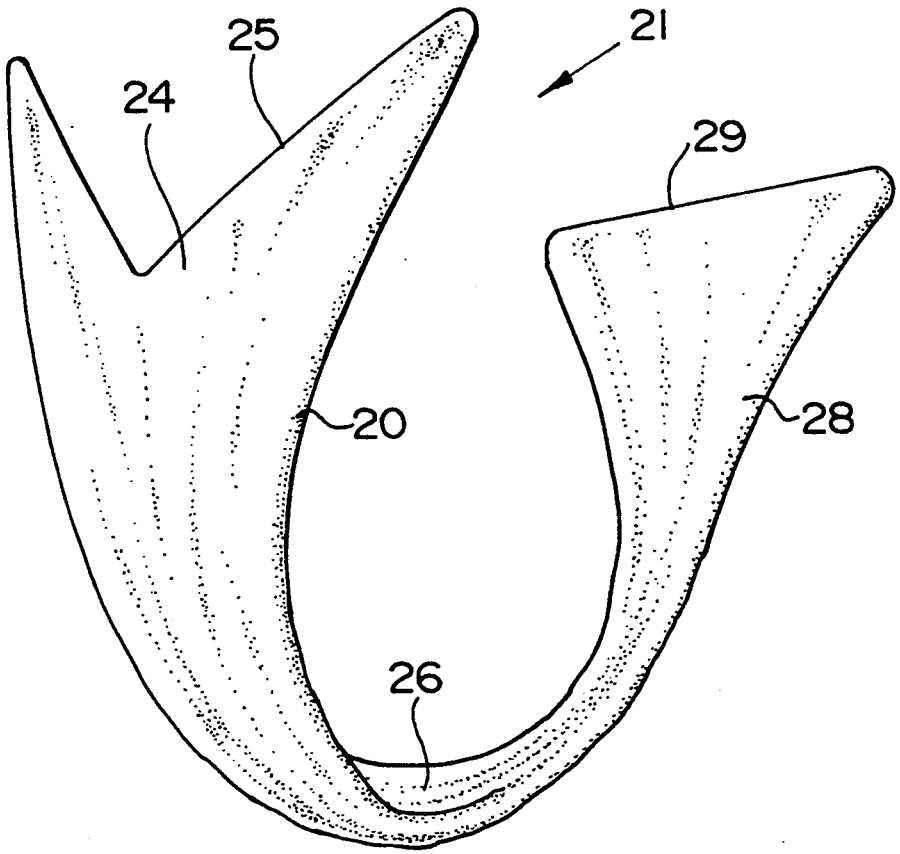
FIG. 4 is a perspective view from the front and one side of a bikini bottom or briefs produced using the frame of FIGS. 1 to 3.
Figure 5:
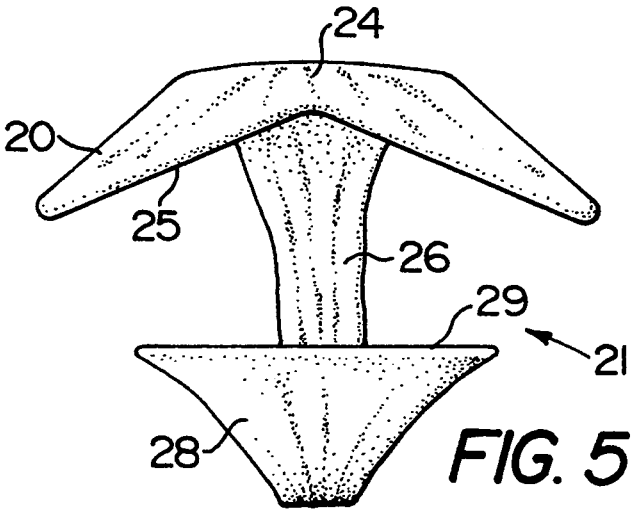
FIG. 5 is a top view of the bottom or briefs of FIG. 4.
Figure 6:
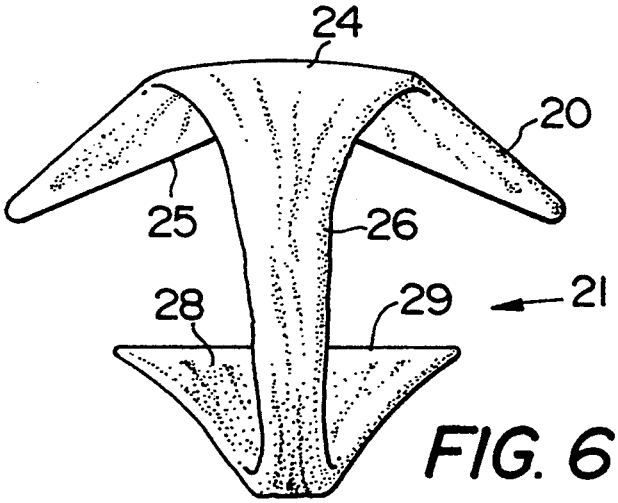
FIG. 6 is a bottom view of the bottom or briefs of FIGS. 4 and 5.
Figure 7:
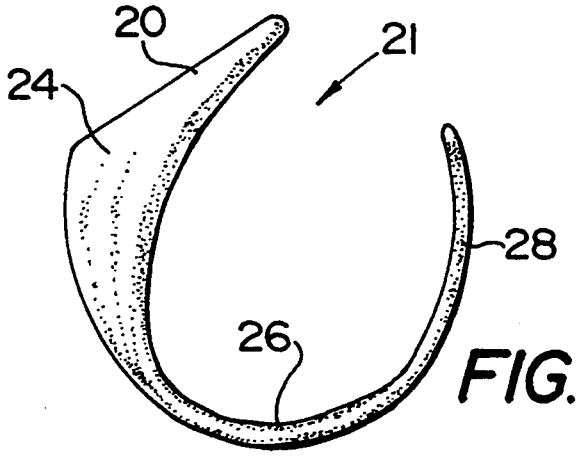
FIG. 7 is a side view of the bottom or briefs of FIGS. 4 to 6.
Figure 8:
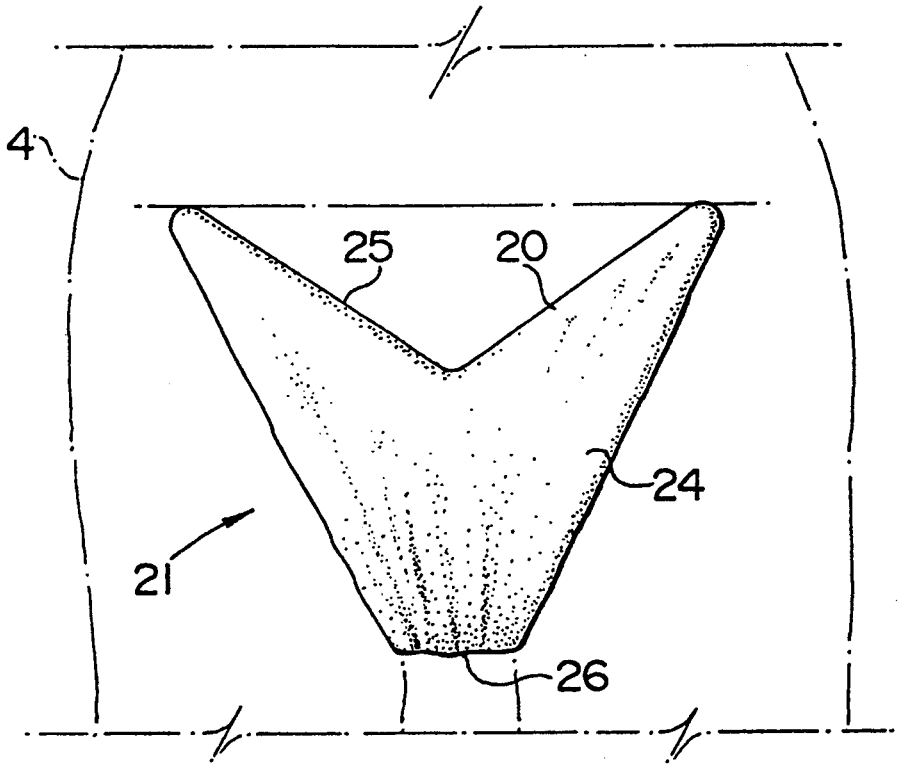
FIG. 8 is a front view of the bottom or briefs of FIGS. 4 to 7.
Figure 9:
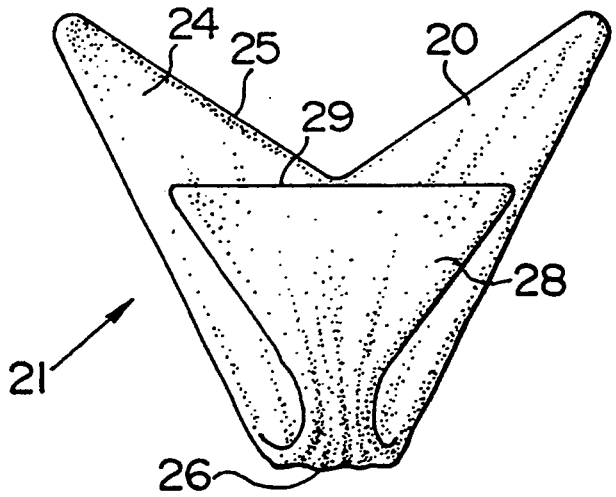
FIG. 9 is a rear view of the bottom or briefs of FIGS. 4 to 8.

With reference to FIGS. 1 to 3, a frame used as a base for the bikini bottoms or briefs of the present invention which is generally indicated at 1 includes a pair of wire members 2 and 3 which are mirror images of each other. Each of the members 2 and 3 includes a single length of wire, which is bent to define a major portion of an oval (FIG. 2) such that if the free ends of the wire were extended to meet, the resulting figure would be more or less drop-shaped. The wire members 2 and 3 are resilient and are intended to extend around the crotch of a wearer 4 (FIG. 8) from above the rectus abdominous muscle in the front to the sacral area in the rear. More specifically, the wire members 2 and 3 extend between a line (FIG. 8) extending approximately between the top of the ilia in the front and the sacrum in the rear of a wearer.

When viewed from the front or the rear, each of the wire members 2 and 3 includes a rectilinear rear portion 6 extending downwardly from an outwardly extending arm 7 to extending downwardly from an outwardly extending arm 7 to approximately the bottom center of the crotch area. Plastic caps 8 are provided on the outer ends 9 of the arms 6. The rear portions 6 are interconnected immediately beneath the arms 7 and at the bottom in the crotch area by conventional cable connectors 10 and 11, respectively.

As best shown in FIG. 3, front portions 12 (in front of the connector 11) extend upwardly and outwardly (when viewed from the front or rear), i.e. diverge from the vertical planes occupied by the rear portions 6 to sharply rounded top corners 13. The corners 13 are located in a horizontal plane 14 above the longitudinal axes of the rear arms 7. The upper ends of the front portions 12 include arms 16 extending downwardly and inwardly from the corners 13 to vertical planes occupied by the rear portions 6 of the wire members. As best shown in FIG. 2, the arms 16 are inclined outwardly from the plane of the main body of the front portions 12 to allow for the curvature of the abdomen of the wearer. Short vertical stems or ends 17 are provided on the arms 16. The ends 17 are interconnected by a connector 18, which is similar to the connectors 10 and 11. A plastic cap 19 is provided on the bottom of the ends 17.

With reference to FIGS. 4 to 9, when the wire frame 1 is covered with a fabric 20 or another flexible material, a finished bikini bottom or briefs generally indicated at 21 is the result. The briefs 21 include a generally triangular front panel 24 with a top edge 25 defining a V-shaped depression. The front panel 24 tapers downwardly to a narrow crotch of the wearer to a rear panel 28. The rear panel 28 is generally triangular with a straight top edge 29.

The top edge of the front panel 24, i.e. the V-shaped depression 25 is located on the rectus abdominous muscle of the wearer. The top edge 29 of the rear panel 28 is located in the sacral area of the wearer, and specifically in the area of the lowest vertebra or sacrum of the wearer. With this structure, i.e. with the long top front and top rear edges, the pressure on the body of the wearer is spread out over a relatively large area of the body. The use of a wire frame extending around the entire periphery of the finished product maintains the structural integrity of the bikini bottom or briefs. However, in spite of the utilitarian aspects of the frame, namely integrity of the structure in use and load distribution, the finished product is aesthetically pleasing.

It will be appreciated that the two lengths of wire used from the frame can be replaced by a single length of wire shaped and bent to form the triangular front and rear panels. Connectors would still be used to hold the straight sides of the rear portion of the frame together, and the free ends of the wires would form the outer ends of the T-shaped top rear of the frame. The use of two separate lengths of wire is preferred for strength and ease of manufacture, assembly being a relatively simple operation.

We claim:

1. A frame for a bikini bottom or briefs comprising a pair of resilient wire members, one said wire member being a mirror image of the other said wire member, each said wire member defining a major portion of an oval of sufficient length to extend around the crotch of a wearer between an approximately V-shaped line on the rectus abdominous muscle in the front and the sacrum in the rear of the wearer, each said member including a rectilinear rear portion for extending downwardly from a top rear of the frame to approximately a bottom center of a crotch area of the frame, an outwardly extending rear arm at a top end of the rear portion, and a front portion including a side flaring outwardly from a vertical plane through said rectilinear rear portion and said bottom center of the crotch area of the frame to a top end of said front portion and a front arm extending downwardly and inwardly from said top end of said front portion to said vertical plane; and connector means for interconnecting said frame members to define a T-shaped rear and a generally triangular front, said front having a generally V-shaped depression in the top end thereof.

2. A frame according to claim 1, wherein said front portion extends upwardly a greater distance than said rear portion of said frame member in a used position.

3. A frame according to claim 2, wherein said front portion of each said member includes vertical stem means on an an inner end of said front arm for receiving a first said connector means.

4. A frame according to claim 3, wherein said front arm is inclined outwardly from a plane of said front portion.

5. A frame according to claim 4, including second connector means for interconnecting said frame means at the top rear immediately beneath the rear arms, and third connector means for interconnecting said frame means at the bottom center in the crotch area.

6. A frame according to the frame of claim 2 in combination with a flexible cover, said cover comprising a triangular rear panel with a straight top edge; a narrow rectangular strip in a crotch area of said cover; and a triangular front panel of greater length than the rear panel, said front panel having a V-shaped top edge.

* * * * *